US009502013B2

(12) United States Patent
Takegawa

(10) Patent No.: US 9,502,013 B2
(45) Date of Patent: Nov. 22, 2016

(54) DEVICE FOR APPLYING TENSION TO A DRUM HEAD

(71) Applicant: PEARL MUSICAL INSTRUMENT CO., Chiba (JP)

(72) Inventor: Akito Takegawa, Chiba (JP)

(73) Assignee: Pearl Musical Instrument Company, Chiba (JP)

( * ) Notice: Subject to any disclaimer, the term of this patent is extended or adjusted under 35 U.S.C. 154(b) by 1 day.

(21) Appl. No.: 14/698,258

(22) Filed: Apr. 28, 2015

(65) Prior Publication Data

US 2015/0310840 A1 Oct. 29, 2015

Related U.S. Application Data

(60) Provisional application No. 61/985,152, filed on Apr. 28, 2014.

(51) Int. Cl.
*G10D 13/02* (2006.01)

(52) U.S. Cl.
CPC ..... *G10D 13/023* (2013.01)

(58) Field of Classification Search
CPC .... G10D 13/026; G10D 13/02; G10D 13/00; G10D 13/021; G10D 13/023; F16B 21/09
USPC ..... 84/411 R, 415
See application file for complete search history.

(56) References Cited

U.S. PATENT DOCUMENTS

| | | | | |
|---|---|---|---|---|
| 2,092,980 | A | 9/1937 | Ludwig | |
| D151,640 | S | 11/1948 | Ludwig | |
| 3,019,685 | A * | 2/1962 | Davis | G10D 13/02 84/411 R |
| 4,122,747 | A | 10/1978 | Yamashita | |
| D279,906 | S | 7/1985 | Ireland | |
| 4,583,442 | A | 4/1986 | Minor | |
| D296,905 | S | 7/1988 | Donnelli | |
| 4,790,229 | A | 12/1988 | Hoshino | |
| 4,928,566 | A | 5/1990 | Yanagisawa | |
| D353,612 | S | 12/1994 | Yanagisawa | |
| 7,495,160 | B2 | 2/2009 | Hoshino et al. | |
| 7,781,660 | B2 | 8/2010 | Paterson | |

* cited by examiner

*Primary Examiner* — Kimberly Lockett
(74) *Attorney, Agent, or Firm* — Manelli Selter PLLC; Edward J. Stemberger

(57) ABSTRACT

A drum tensioning device is provided. The drum tensioning device can include an insert having a flange and a shank. The shank can be configured to engage a tension rod. The tensioning device can also include a casing having a mount configured to receive a connecting member to secure the casing to a shell of the drum. The casing can further include an opening formed in the casing through which the shank of the insert extends and a recess formed on an inner surface of the casing configured to retain the flange of the insert while permitting for radial and axial movement of the shank relative to the opening.

20 Claims, 4 Drawing Sheets

DEVICE FOR APPLYING TENSION TO A DRUM HEAD

CROSS-REFERENCE TO RELATED APPLICATIONS AND CLAIM TO PRIORITY

This application claims the priority of U.S. Provisional Patent Application No. 61/985,152, filed Apr. 28, 2014, which is incorporated herein by reference.

FIELD OF THE INVENTION

The present invention is directed to a drum, such as a snare drum, a bass drum, a tom-tom, or the like, and more particularly, to an improved tensioning device to provide tension to a drum skin.

BACKGROUND

A drum is a percussion musical instrument that can include a cylindrical drum body or shell defining a typically hollow chamber and a drum skin on one or both ends of the shell. Each drum skin can be mounted in a counter hoop to support the skin. A lug can be provided to couple the hoop to the shell of the drum using a tension rod to aid in tensioning the drum skin.

Various types of lugs have been used such as tube lugs and hollow cast lugs in the tensioning devices. A tube lug includes a casing having a tube shape where an end of the casing is threaded to receive the tension rod. However, if the tube of the casing is not perfectly aligned with the tension rod, the tension rod may thread onto the tube at odd angles and cause misalignment. Misaligned tension rods can create undesirable stress on the shell and undesirably affect the resonance and pitch of the drum.

A hollow cast lug can be used to provide better alignment with the tension rod to reduce stress applied to the shell and improve resonance within the shell. The hollow cast lug can include an insert to receive the tension rod, and a spring or elastic material such as rubber to hold the insert in place. However, the spring or elastic material may undesirably affect acoustic characteristics of the drum.

SUMMARY OF THE INVENTION

An aspect of the invention provides a drum tensioning device. The drum tensioning device can include an insert having a flange and a shank. The shank can be configured to engage a tension rod. The tensioning device can also include a casing having a mount configured to receive a connecting member to secure the casing to a shell of the drum. The casing can further include an opening formed in the casing through which the shank of the insert extends and a recess formed on an inner surface of the casing configured to retain the flange of the insert while permitting radial and axial movement of the shank relative to the opening.

Another aspect of the invention provides a drum. The drum can include a shell having a first end and a second end. The first end and the second end can be open in the axial direction. The drum can further include a drum skin overlaying the first end of the shell, a hoop securing the drum skin to the first end of the shell, a tension rod coupled to the hoop, and a tensioning device coupled to the shell and configured to act on the hoop to provide tension to the drum skin. The tensioning device can include an insert having a flange and a shank. The shank can be configured to receive the tension rod coupled to the hoop. The tensioning device can further include a casing having a mount secured to the shell of the drum and an inner surface providing an opening through which the shank of the insert extends. A recess configured to retain the flange of the insert while permitting for radial and axial movement of the shank relative to the opening can be provided on the inner surface.

A third aspect of the invention provides a method of tensioning a drum. A drum skin can be provided over a first open end of a shell. The drum skin can be secured to the first end of the shell with a hoop. The drum skin can be tensioned by engaging a tension rod with a tensioning device coupled to the shell. The tensioning device can include an insert having a flange and a shank. The shank can be configured to receive the tension rod. The tensioning device can also include a casing including a mount secured to the shell of the drum and an inner surface providing an opening through which the shank of the insert extends and a recess configured to retain the flange of the insert while permitting for radial and axial movement of the shank relative to the opening.

Other aspects of the invention, including apparatus, articles, methods, systems, assemblies, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description, serve to explain the principles of the invention. In such drawings.

DETAILED DESCRIPTION OF EXEMPLARY EMBODIMENT(S)

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods.

Figure 1:
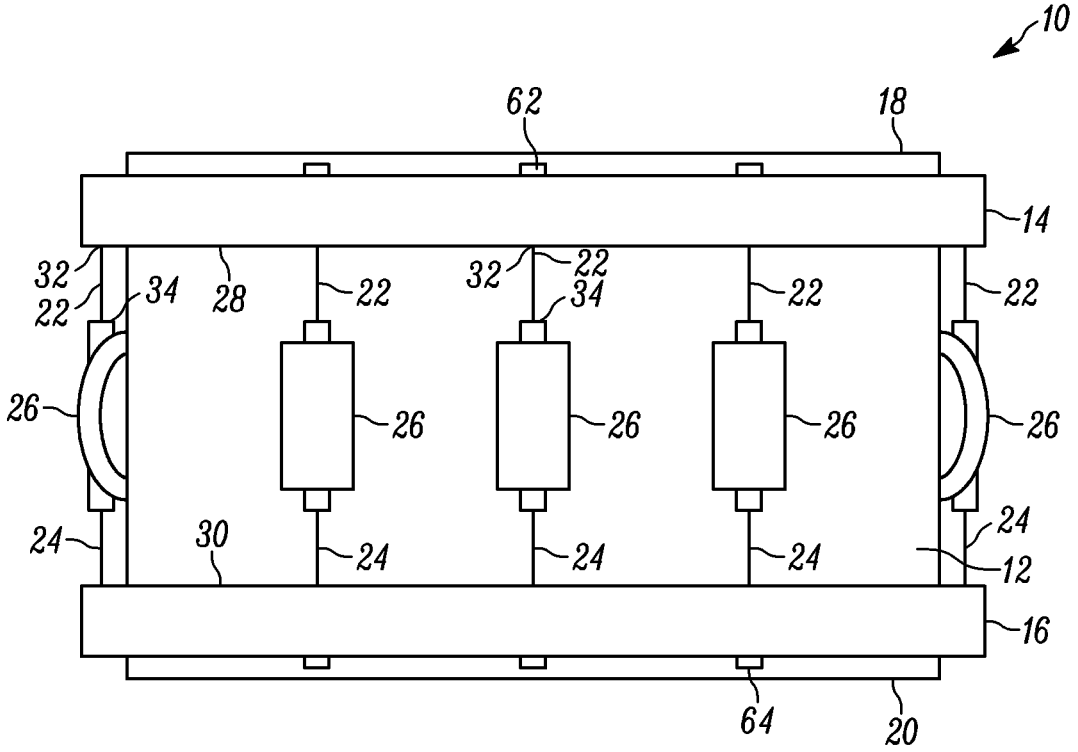
FIG. 1 is a side elevational view of an exemplary drum according to an exemplary embodiment of the present disclosure.

FIG. 1 illustrates a drum 10 according to an exemplary embodiment of the present disclosure. Drum 10 can include a shell 12, an upper hoop 14, a lower hoop 16, an upper drum skin 18, a lower drum skin 20, an upper tensioning rod 22, a lower tensioning rod 24, and a tensioning device 26 interconnecting the upper and lower tensioning rods 22, 24. Tensioning devices 26 are also known and referred to herein as lugs. Preferably, there are a plurality of tensioning devices 26 equiangularly disposed about the drum 10.

The drum shell 12 can include a first end 28 and a second end 30. The drum shell 12 can have a cylindrical shape such that the first end 28 and the second end 30 are open in the axial direction. The drum shell 12 can be made of various materials. For example, the drum shell 12 can comprise wood, metal, acrylic, etc. The drum shell 12 can be associated with any other type of drum such as base, tom-tom, etc.

The upper hoop 14 can be an annular member configured to secure the upper drum skin 18 to the drum shell 12. For example, the upper hoop 14 can surround the first end 28 of the drum shell 12 to provide tension to the upper drum skin 18 by pressing the skin 18 against the rim of the first end 28 of the drum shell 12. When a force is applied to the drum skin 18 under tension, such as by a stick or mallet, a vibration can be produced that resonates within and is amplified by the shell 12 thus creating a sound. The lower hoop 16, the lower drum skin 20, and the lower tensioning rod 24 generally have the same relationships to one another as their corresponding upper parts 14, 18, and 22. In the interest of brevity, discussion will be limited to the upper parts, with the understanding that the lower parts are constructed and operate in similar manner.

Figure 2:
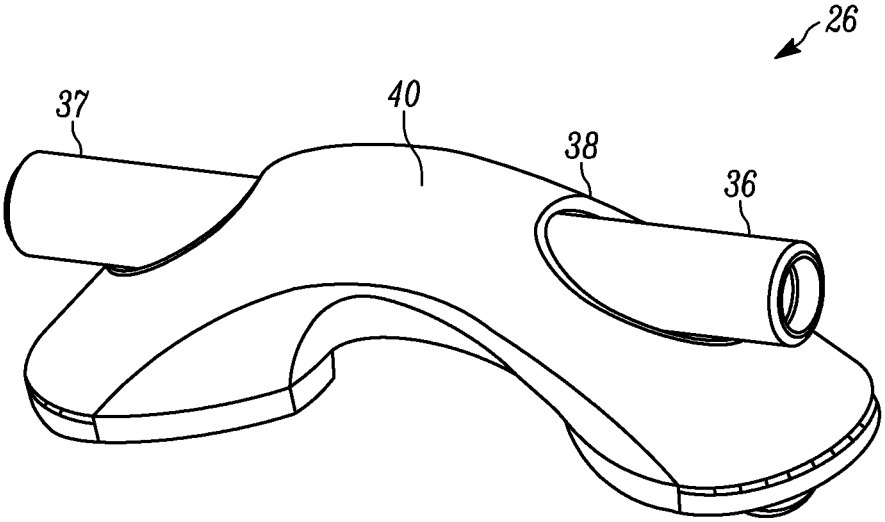
FIG. 2 is a top perspective view of an exemplary tensioning device according to an exemplary embodiment of the present disclosure.
Figure 3:
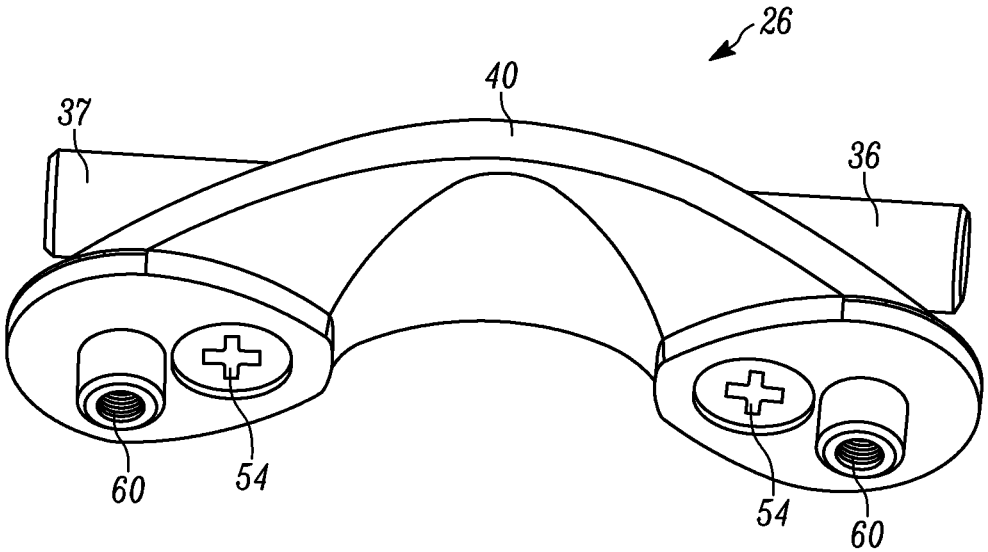
FIG. 3 is a bottom perspective view of an exemplary tensioning device according to an exemplary embodiment of the present disclosure.

Tension can be maintained on the drum skin 18 after the drum skin 18 is secured to the shell 12. For example, a first end 32 of the tension rod 22 can be coupled to the hoop 14 and a second end 34 of the tension rod 22 can be secured to the tensioning device or lug 26. In an exemplary embodiment, the second end 34 of the tension rod 22 is threaded into an insert 36 (FIG. 2) of the tensioning device 26. The insert 36 can pass through an opening 38 in a casing 40 of the tensioning device 26. The opening 38 of the casing 40 is slightly larger in diameter than the diameter of the outer surface of the insert 36, such that the insert 36 can move in radial and axial directions as the second end 34 of the tension rod 22 is threaded into the insert 36. The size differences allow the insert 36 to self-align with the tension rod 22 for smooth engagement of the insert 36 and the tension rod 22. In an exemplary embodiment, a plurality of tensioning devices 26 can be arranged to be equally spaced about drum shell 12 as well as spaced equidistant between upper hoop 14 and lower hoop 16. Alternatively, the tensioning devices 26 can be positioned closer to upper hoop 14 or lower hoop 16.

FIGS. 2-5 illustrate various views of an exemplary tensioning device 26 according to an exemplary embodiment of the present invention. The tensioning device 26 as illustrated includes two inserts 36, 37 and a casing 40. While two inserts 36, 37 are illustrated in FIGS. 2-5, only one insert 36 can be used. For example, a one-insert tensioning device 26 may be desired when the upper drum skin 18 is secured to the first end 28 of the drum shell 12, but the lower drum skin 20 is absent. Optionally, the casing 40 may have only a single opening 38 where only a single insert 36 is used. When two inserts 36, 37 are used with a tensioning device 26, each insert 36, 37 is separate from the other allowing the tension rods 22, 24 to move in the radial and axial directions independently of one another to self-align during engagement with the tensioning device 26. In other words, tension to upper drum skin 18 can be adjusted independently from lower drum skin 20 using tensioning rod 22 where tensioning rods 22, 24 are separately adjustable. Preferably, the two inserts 36, 37 point in approximately opposing directions from each other and are independently operable to align tensioning rods 22, 24. The tensioning rod 22 can be operated to tighten (or loosen) the upper drum skin 18without affecting the tension of the tensioning rod 24; and the tensioning rod 24 can be operated to tighten (or loosen) the lower drum skin 20 without affecting the tension of the tensioning rod 22. Inserts 36, 37 are receptacles for the tension rods 22, 24. Tension is applied to drumheads 18, 20 by turning the tension rods 22, 24 typically clockwise. To loosen tension on drumheads 18, 20 the user turns tension rod 22, 24, typically counter clockwise. Inserts 36, 37 have flanges 42 that fit into recesses 48, 46 to prevent inserts 36, 37 from spinning Inserts 36, 37 do not spin while accepting tension rods 22, 24, although the fit allows inserts 36 & 37 to self-align with tension rods 22, 24 so the threads fit properly without misalignment that could result in damage to the tension rods 22, 24 or inserts 36, 37.

Figure 5:
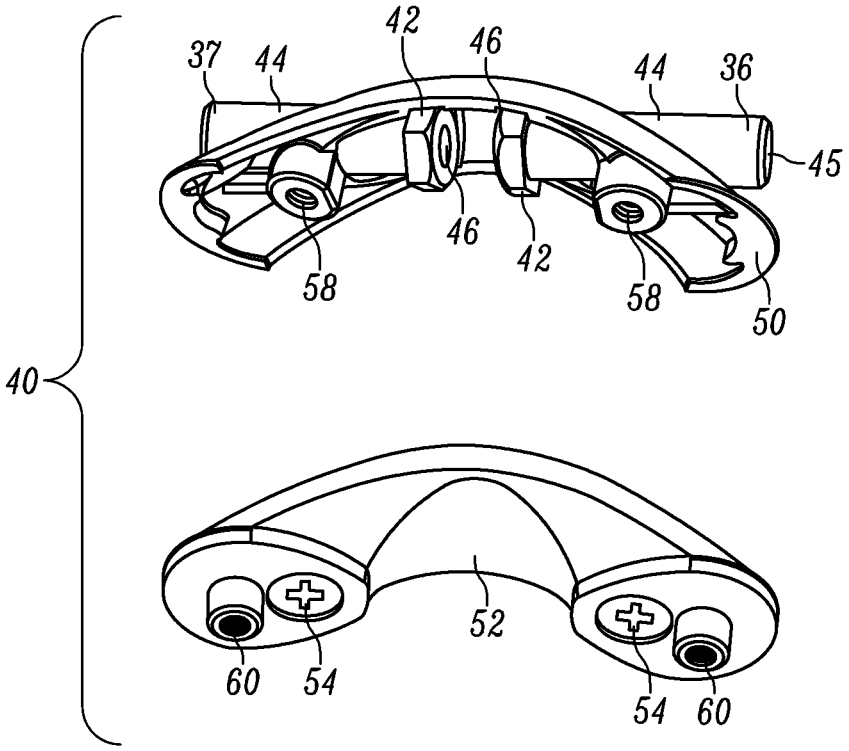
FIG. 5 is an exploded bottom assembly view of an exemplary tensioning device according to an exemplary embodiment of the present disclosure.

As best shown in FIG. 5, each insert 36, 37 can include a flange 42 and a coaxial shank 44. The insert 36, 37 can be manufactured from various materials such as metal, synthetic, or semi-synthetic materials. The flange 42 can have any shape, such as a rounded and/or a polygonal shape. In an exemplary embodiment, flange 42 can have a square or hexagonal shape. In another exemplary embodiment, flange 42 can have a generally polygonal shape, e.g. a shape having three or more substantially straight sides, where the edges of the flange 42 can be rounded. The flange 42 is sized and shaped to preclude the insert 36, 37 from being pulled through the opening 38 when tension is applied to the drum skin. Shank 44 may be a hollow tube-like member. The shank 44 can have a threaded interior surface 45 and a smooth exterior surface. The threaded interior surface allows for connection of the shank 44 to the tensioning rod 22, 24 by screwing one end of the tensioning rod into the shank 44. Tensioning (or loosening) of the drum skin 20 is accomplished by turning at least one of the tensioning rods 22, 24. Because the tensioning rods 22 or 24 are connected to the shank by the treads, turning of the tensioning rods 22, 24 in one direction (usually counterclockwise) loosens the tension on the tensioning rods 22 or 24; and turning the tensioning rods 22, 24 in the opposite direction (usually clockwise) increases the tension on the associated tensioning rods 22 or 24, respectively. Alternatively, each of the tensioning rods 22 may be tightened (or loosened) at its first end 32 connected to its respective hoop 14. In an exemplary embodiment, tensioning rods 22 are positioned through holes in the hoop 14 and held in place by rod heads 62, as best illustrated in FIG. 1. Each rod head 62 is an integral part of its respective tensioning rod 22 and is larger than the hole in the hoop 14 to hold the tensioning rod 22 on the hoop 14. The tensioning rods 24 may also be similarly positioned relative their respective hoop 16 by their respective rod heads 64. The rod head 62 or 64 may turned by a wrench or "drum key" that is fitted to the rod head 62 or 64 by the user to allow the user to rotate the tensioning rod 22 or 24 in order to independently increase or decrease, as desired, the tension applied to the drum head 18 or 20. For example, the each of the rod heads 62, 64 may have a hexagonal socket therein, so that the tensioning rods 22, 24 may be turned using a hex key (or Allen key). The flanges 42 and recesses 46, 48 have complementary shapes and sizes to prevent the flanges 42 from turning or spinning during use and/or during adjustment.

Figure 4:
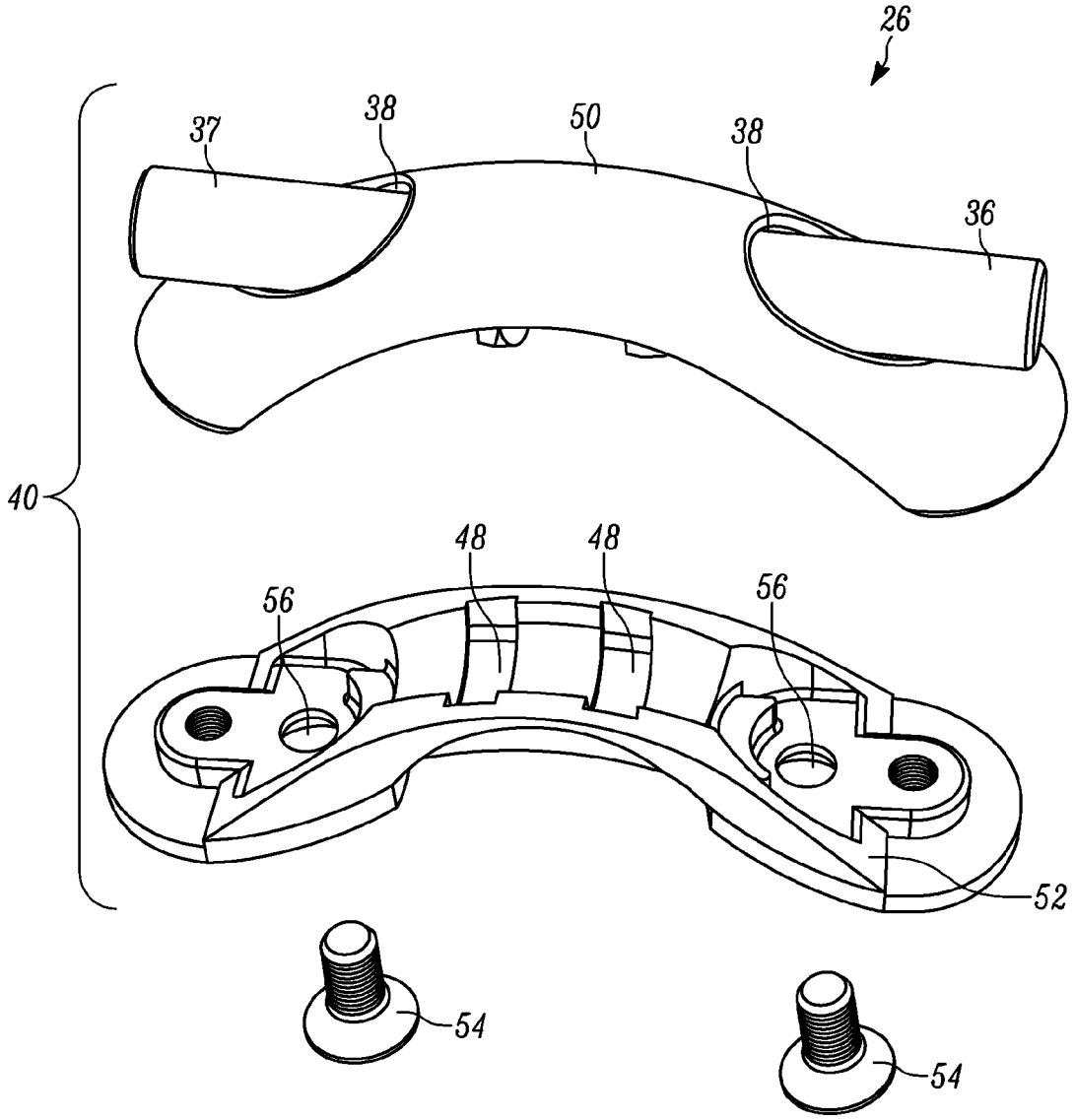
FIG. 4 is an exploded top assembly view of an exemplary tensioning device according to an exemplary embodiment of the present disclosure.

The casing 40 can have an elongated curvilinear body with at least a portion of the inserts 36, 37 being housed within the casing 40. For example, the flange 42 can be disposed within first and second recesses 46, 48, as best shown in FIG. 4, and the shank 44 can extend through the opening 38 formed in the casing 40. The recesses 46, 48 are shaped such that, when the tensioning device 26 is assembled, the recesses hold the inserts 36, 37 in place and prevent the inserts 36, 37 from turning or spinning on their respective center axis, even when tension is applied to the tensioning rods 22, 24. The length of the body of the casing 40 can be associated with the type of drum to which the tensioning device 26 is coupled. For example, the length of the body for an embodiment of the casing 40 used on a snare drum can be shorter than the length of the body for an embodiment of the casing 40 used on a bass drum. The casing 40 can be made using various manufacturing techniques such as die casting, precision machining, and injection molding, etc. The material used for casing 40 can be the same or different than the material used for the insert 36. For example, the casing 40 can be made of steel, chrome plated metal, zinc, aluminum, plastic, etc.

The elongated body of the casing 40 can be a single member or can be formed from a plurality of members such as a first (upper) plate 50 and a second (lower) base member or plate 52, as best shown in FIGS. 4 and 5. In an exemplary embodiment, the casing 40 can include a curved or arched configuration such that a portion of the casing is spaced from the drum shell 12. The first recess 46 can be formed on a first inner surface of casing 40 and the second recess 48 can be formed on a second inner surface of casing 40 such that the recesses 46, 48 are aligned to receive the flange 42 of the insert 36 or 37, as best shown in FIG. 5. When the casing 40 includes the first plate 50 and the second plate 52, the first inner surface of the first plate 50 can include the first recess 46 and the second inner surface of the second plate 52 can include the second recess 48. The first and second recesses 46, 48 are designed to receive and retain the flange 42 within the casing 40. The recesses 46, 48 are shaped to hold the flanges 42 in place to prevent the inserts 36, 37 from turning or spinning on their respective center axis, even when tension is applied to the tensioning rods 22, 24. The shape of the recesses 46, 48 may match the shape of the associated flanges or may be differently shaped as long as the shapes prevent the flanges 42 (and thus the inserts 36, 37) from turning or spinning when the tensioning device 26 is assembled.

As best shown in FIG. 5, case fasteners 54 can be used to couple the plates 50 and 52 together where fasteners 54 pass through openings 56 formed in plate 52. In the illustrated embodiment, the case fasteners 54 are shown as screws. The shanks of the case fasteners 54 are received in threaded openings of bosses 58 of the upper plate 50. The lower plate 52 may have countersinks for receiving the heads of the case fasteners 54. A screwdriver may be used to remove the case fasteners 54 and allow separation of the upper and lower plates 50 and 52 from one another. It should be understood that alternative fasteners may be used. In addition or as an alternative, the upper and lower plates 50 and 52 may be permanently adhered to one another.

The recesses 46 and 48 can have a depth and a width slightly larger than the corresponding dimensions (i.e., the width and the length) of the flanges 42 to allow for adjusting movement of the insert 36in the radial and axial directions as the tension rod 22, 24 is engaged with the associated insert 36, 37. The recesses 46 and 48 each can have a shape corresponding to the shape of the flange 42. For example, when the flange 42 has a hexagonal shape, the recesses 46 and 48 can collectively provide corresponding hexagonal walls conforming to the external profile of the flange 42 to allow the flange 42 to snuggly rest within the recesses 46, 48 such that no coupling techniques (e.g., fasteners, adhesive, etc.) are necessary to maintain the flange within the recesses 46 and 48. Preferably, the recesses 46 and 48, and the flanges 42 have corresponding polygonal shapes, including triangular, square, pentagonal, and hexagonal shapes. It is important that the recesses 46, 48 are sized sufficiently to prevent the flange 42 (and thus the insert 36 or 37) from turning or spinning on its own axis (when the tensioning rods 22 or 24 are under tension), but are also sufficiently loose to allow the insert 36 or 37 to move in the radial and axial directions to align itself with its respective tensioning rod 22 or 24. Proper alignment allows the threads of the tensioning rods 22, 24 and of the inserts 36, 37 to engage properly to avoid damage to the tensioning mechanism.

The opening 38 can be formed within the casing 40 to allow the shank 44 to extend through the casing 40 to receive the tension rod 22. The inner surface of the shank 44 at the opening 38 may be threaded to engage with corresponding threads on the outer surface of the tension rod 22. The opening 38 can be configured such that the opening 38 has an area greater than the circumference of the shank 44 of the insert 36 to allow a clearance for the shank 44 to move in the radial and axial directions. When the casing 40 is formed from a plurality of plates, such as the plates 50, 52, the opening 38 can be formed wholly within one plate, for example plate 50, as illustrated in FIGS. 2-5. Alternatively, a portion of the opening 38 can be formed in one plate, for example the plate 50, and another portion of the opening 38 can be formed in another plate, for example the plate 52, such that when the plates 50, 52 are coupled together, the portions of opening 38 align to allow shank 44 to extend through the casing 40. Alternatively, the opening 38 can be formed in the lower plate 52 only.

A mounting projection 60 can extend from casing 40, as best shown in FIG. 5. For example, when casing 40 comprises first plate 50 and second plate 52, the mounting projection 60 can extend from an outer surface of the second plate 52. The mounting projection 60 can allow the tensioning device 26 to be coupled to drum shell 12. In an exemplary embodiment, mounting projection 60 can be mounted within a hole formed in drum shell 12 and a fastener 54, such as a screw, can be threaded through the drum shell 12 into the mounting projection 60 to secure the tensioning device 26 to the shell 12. In an embodiment, when mounted, the tensioning device 26 contacts the drum shell 12 at two areas of the second plate 52 which are adjacent to the mounting projections 60. The portion of the tensioning device 26 between those two areas is not in contact with the drum shell 12.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

What is claimed is:

1. A drum tensioning device, comprising:

an insert comprising a flange and a shank, wherein the shank is configured to engage a tension rod that is separate from the insert; and a casing comprising a mount configured to secure the casing to a shell of the drum, an opening formed in the casing through which the shank of the insert extends, and a recess formed on an inner surface of the casing configured to retain the flange of the insert and keep the insert from spinning while permitting for radial and axial movement of the shank relative to the opening for aligning with the tension rod.

2. The device of claim 1, wherein the recess has a depth greater than a width of the flange.

3. The device of claim 1, wherein the recess has a width greater than a length of the flange.

4. The device of claim 1, wherein the casing is formed by a first plate providing a first portion of the inner surface, the first inner surface portion configured with a first portion of the recess for receiving a first portion of the flange; and a second plate providing a second portion of the inner surface, the second inner surface portion configured with a second portion of the recess for receiving a second portion of the flange.

5. The device of claim 4, wherein:

the first plate comprises at least a portion of the opening, and the second plate comprises the mount.

6. The device of claim 1, wherein the insert is made of a first material and the casing is made of a second material different from the first.

7. The device of claim 1, wherein the flange of the insert is polygonal.

8. The device of claim 1, further comprising a second insert comprising a second flange and a second shank, wherein the second shank is configured to engage a second tension rod that is separate from the second insert; and wherein the casing further comprising a second opening formed in the casing through which the second shank of the second insert extends; and a second recess formed on the inner surface of the casing configured to retain the second flange of the second insert and keep the second insert from spinning while permitting for radial and axial movement of the second shank relative to the second opening for aligning with the second tension rod.

9. The device of claim 8, wherein the opening and second opening are configured to allow the insert and second insert to point in opposing directions, and wherein the insert and second insert are independently operable.

10. A drum, comprising:

a shell having a first end and a second end, wherein the first end and the second end are open in the axial direction;

a drum skin overlaying said first end;

a hoop securing the drum skin to said first end;

a tension rod coupled to said hoop; and a tensioning device coupled to said shell and configured to act on the hoop to provide tension to said drum skin, the tensioning device comprising an insert, separate from said tension rod, comprising a flange and a shank, wherein said shank receives said tension rod, and a casing comprising a mount secured to said shell, an opening through which said shank extends; and a recess formed on an inner surface of said casing to retain said flange and keep the insert from spinning while permitting radial and axial movement of said shank relative to the opening for aligning with said tension rod.

11. The drum of claim 10, wherein the recess has a depth greater than a width of the flange.

12. The drum of claim 10, wherein the recess has a width greater than a length of the flange.

13. The drum of claim 10, wherein the casing is formed by a first plate providing a first portion of the inner surface, the first inner surface portion configured with a first portion of the recess for receiving a first portion of the flange; and a second plate providing a second portion of the inner surface, the second inner surface portion configured with a second portion of the recess for receiving a second portion of the flange.

14. The drum of claim 13, wherein:

the first plate comprises at least a portion of the opening, and the second plate comprises the mount.

15. The drum of claim 10, wherein the insert is made of a first material and the casing is made of a second material different from the first.

16. The drum of claim 10, wherein the flange of the insert is polygonal.

17. The drum of claim 10, further comprising:

a second drum skin overlaying the second end of the shell;

a second hoop securing the second drum skin to the second end of the shell; and a second tension rod coupled to the second hoop, wherein the tensioning device is also configured to act on the second hoop to provide tension to the second drum skin, the tensioning device further comprising a second insert, separate from the second tension rod, comprising a second flange and a second shank, wherein the second shank receives the second tension rod, and wherein the casing further comprising a second opening through which the second shank extends, and a second recess on the inner surface of the casing to retain the second flange of the second insert and keep the second insert from spinning while permitting for radial and axial movement of the second shank relative to the second opening for aligning with the second tension rod.

18. The drum of claim 17, wherein the opening and second opening are configured to allow the insert and second insert to point in opposing directions, and wherein the insert and second insert are independently operable.

19. The drum of claim 10, wherein a plurality of tensioning devices are equiangularly disposed about the drum.

20. A method of tensioning a drum, comprising:

providing a drum skin over a first open end of a shell;

securing the drum skin to the first end of the shell with a hoop;

coupling a first end of a tension rod to the hoop; and tensioning the drum skin by engaging a second end of the tension rod with a tensioning device coupled to the shell, the tensioning device comprising an insert, separate from the tension rod, comprising a flange and a shank, wherein the shank receives the tension rod, and a casing comprising a mount secured to the shell of the drum, an opening through which the shank of the insert extends; and a recess formed on an inner surface of the casing to retain the flange of the insert and to keep the insert from spinning while permitting for radial and axial movement of the shank relative to the opening for aligning with the second end of the tension rod.

* * * * *